US005553473A

United States Patent [19]

Keller

[11] Patent Number: 5,553,473

[45] Date of Patent: Sep. 10, 1996

[54] ROTARY LOCKING CYLINDER FOR A SAFETY LOCK

[76] Inventor: Ernst Keller, Untere Schwandenstrasse 22, CH-8805 Richterswil, Switzerland

[21] Appl. No.: 293,382

[22] Filed: Aug. 19, 1994

[30] Foreign Application Priority Data

Oct. 5, 1993 [EP] European Pat. Off. ..... 93810702

[51] Int. Cl.[6] ..... E05B 27/06

[52] U.S. Cl. ..... 70/358; 70/421; 70/493; 70/DIG. 37

[58] Field of Search ..... 70/358, 421, 492, 70/493, 377, 378, 387, 392, 419, 495, 496, DIG. 37

[56] References Cited

U.S. PATENT DOCUMENTS

| | | | |
|---|---|---|---|
| 772,112 | 10/1904 | Oleschak | 70/492 |
| 1,958,603 | 5/1934 | Bacon | 70/421 |
| 2,003,086 | 5/1935 | Liss | 70/DIG. 28 |
| 2,408,283 | 9/1946 | Wollin | 70/419 |
| 2,879,658 | 3/1959 | Johnstone | 70/419 |
| 3,455,130 | 7/1969 | Basseches | 70/421 |
| 4,760,722 | 8/1988 | Fann et al. | 70/358 |

*Primary Examiner*—Darnell M. Boucher
*Attorney, Agent, or Firm*—McAulay Fisher Nissen Goldberg & Kiel, LLP

[57] ABSTRACT

The rotary locking cylinder has a housing with a longitudinal bore hole in which a rotor is inserted. In the lower region of the bore hole, a groove-shaped recess is worked into the housing, a blocking insert being inserted into this recess. This blocking insert projects into the key groove and prevents the rotor from being turned by force so as to shear off the tumbler pins. When employing unauthorized opening methods, the blocking insert must be held against the repelling force of spring elements in an inactive position, which substantially impedes such unauthorized methods or even renders them impossible.

12 Claims, 3 Drawing Sheets

ROTARY LOCKING CYLINDER FOR A SAFETY LOCK

BACKGROUND OF THE INVENTION

1. Field of the Invention

The invention is directed to a rotary locking cylinder and, in particular, to a rotary locking cylinder for a safety lock in which spring-loaded pin tumblers are supported in bore holes extending radially relative to a rotor and a cylinder housing and can be brought into line by inserting a key into a key groove to enable the rotation of the rotor.

2. Description of the Related Art

A rotary locking cylinder of this type is known, for example, from EP-B-0 238 442. In break-in attempts, even high-priced rotary locking cylinders of this kind are subject to a wide variety of known and new methods of opening. Some of these methods are non-destructive and incapable of detection. The rotary locking cylinder according to the patent mentioned above foils such methods, e.g. the vibration method, by way of a special a construction of the tumblers. However, there are also methods of unauthorized opening in which the rotary locking cylinder is destroyed by the use of crude force. When attempting to open the lock in this way, for example, rotation of the rotor is forced by inserting a tool into the key groove so that the tumbler pins are sheared off. This forced method of entry is difficult to combat by modifying the rotary locking cylinder, since such changes are restricted by preestablished dimensions. Finally, such a rotary locking cylinder should be simple and inexpensive to manufacture and should operate reliably. A rotary locking cylinder which at least substantially impedes a number of methods of unauthorized opening at the same time would be particularly desirable.

OBJECT AND SUMMARY OF THE PRESENT INVENTION

The invention therefore has the primary object of providing a rotary locking cylinder of the type mentioned above which offers better protection against attempts at unauthorized opening but is not substantially more expensive to produce. This object is met by the invention wherein the improvement comprises a blocking insert which is supported in the housing and engages in the key groove and is displaced outward against a repelling spring force when the key is inserted in order to free the rotor for rotation.

In the rotary locking cylinder according to the invention the above-mentioned break-in attempts are substantially impeded. Forced turning of the rotor is impeded by increasing the shearing cross section, i.e. the tailor-made tool employed for this purpose must be inserted into the key groove along the entire length of the latter. The tool which is inserted into the key groove strikes against the core pins due to the spring pressure of the blocking insert. These core pins are accordingly moved outward radially, which results in a positive blocking by means of the core pins. It is almost impossible to force a rotor which is blocked in this way.

In order to use the lock-picking method or vibration method, the blocking insert would have to be held against the spring pressure at the locking level along the entire length of the key groove while attempting to open the lock. Accordingly, additional manipulation is required so that the opening method is made more difficult and the period of time required to successfully open the lock is increased.

As will be seen, entirely different types of opening methods are substantially impeded by the rotary locking cylinder according to the invention.

The rotary locking cylinder can be operated in a conventional manner with its accompanying key. When the key is inserted into the key groove, the blocking insert is automatically moved outward into an inactive position.

The rotary locking cylinder according to the invention can be manufactured in a particularly simple manner according to a further development when the insert is inserted in a recess of the housing which is open toward the rear. In this case, the insert can be pushed into a longitudinal recess of the housing in the manner of a slide or bolt. The insertion of the blocking insert may be effected during assembly of the rotary locking cylinder much as the insertion of the housing pins. The insertion of the blocking insert can accordingly be integrated very simply in a known production process. This is an important feature in series-manufactured products.

The locking security is considerably increased in a further development of the invention in that the blocking insert has a plurality of parts arranged one after the other which must be displaced outward individually in order to release the rotor. Accordingly, a plurality of parts of the blocking insert must be brought into the inactive position simultaneously when unauthorized opening is attempted.

The locking security is further increased in that the blocking insert is held in the blocking position by means of at least two spring elements which are arranged at a distance from one another. Such a blocking insert is also still effective when pressed outward at only one end. In this case, the blocking insert is only inclined and the end which is not acted upon continues to lock the rotor.

The rotary locking cylinder according to the invention can also be a double locking cylinder having two individual parts joined by a connecting web. In this case, the blocking inserts are installed before connecting the individual cylinders. Accordingly, the blocking inserts can also be pushed in from the rear in this instance. Further advantageous features are contained in the following claims and the description and drawing.

DESCRIPTION OF THE PREFERRED EMBODIMENTS

Figure 1:
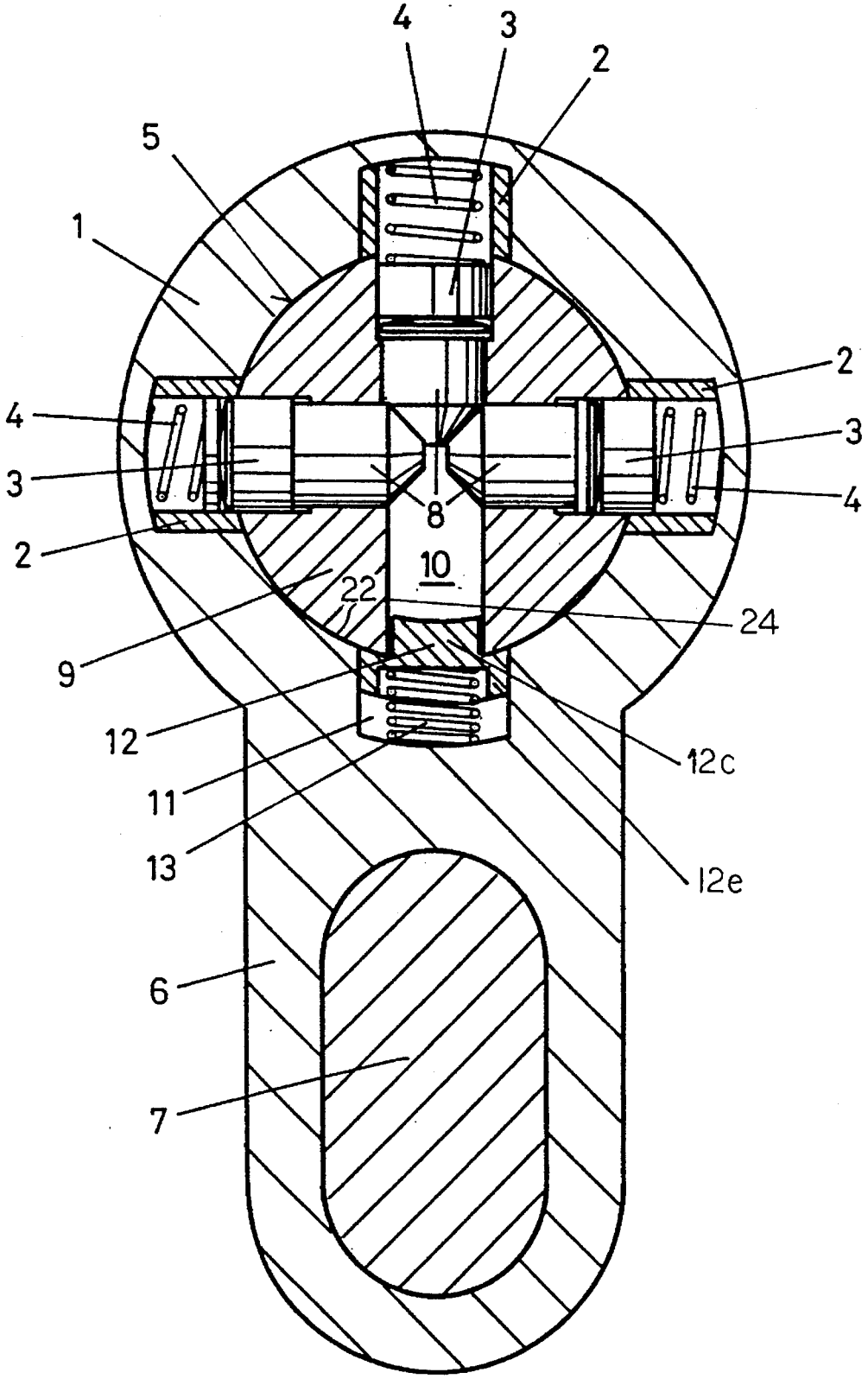
FIG. 1 shows a cross section through a rotary locking cylinder according to the invention.

The rotary locking cylinder has a housing with a continuous bore hole 5 in which a rotor 9 is inserted. Spring-loaded tumblers with springs 4, core pins 8 and housing pins 3 are inserted into radial bore holes in the rotor 9 and into inserts 2 of the housing 1 in a known manner. A flat key or turn key 14 is inserted into an open key groove 10 to enable rotation. Key groove 10 is defined by external face 20, circumferential surface 22, and internal wall 24 of rotor 9. If the rotary locking cylinder has two individual cylinders, these cylinders are connected with one another by a web 7 inserted into the cylinder pocket 6. The rotary locking cylinder according to the invention can be a single rotary locking cylinder or double rotary locking cylinder.

A recess 11 extending in the longitudinal direction of the rotary locking cylinder is worked into the housing 1 in the lower region of the bore hole 5. As will be seen from FIG. 2*a*, this recess is open at the rear, i.e. with reference to the figure, while it is closed in the front. A blocking insert 12 having two parts 12*a* and 12*b* which are T-shaped in cross section and made of brass, for example, is inserted into this groove-shaped recess 11. The parts 12*a* and 12*b* have two pocket bore holes 12*c* in the underside, spiral springs 13 being inserted into the latter. The spiral springs 13 supported at the housing 1 hold parts 12*a* and 12*b* in the position shown in FIGS. 1 and 2*a*. Since, as can be seen in the drawing, parts 12*a* and 12*b* project into the key groove 10 which is open at the bottom, the blocking insert 12 connects the rotor with the housing 1 in the position shown in the drawing. Accordingly, the rotor could not be turned even when the tumblers are brought into line. Consequently, a lock with this rotary locking cylinder could not be opened by a break-in method in which the tumblers are simply brought into line.

Figure 2A:
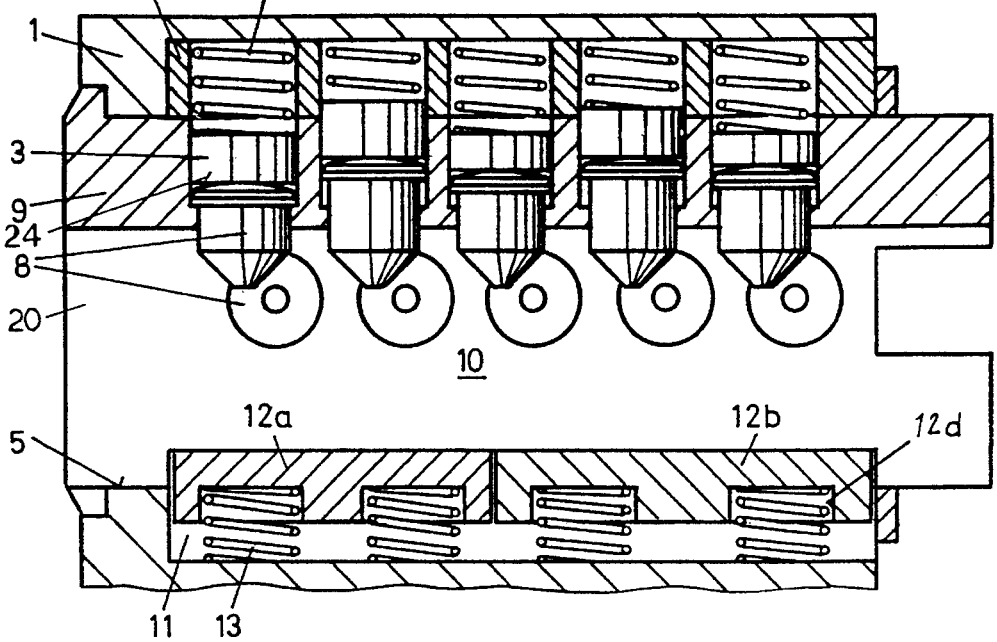
FIGS. 2*a* to 2*c* show longitudinal sections through the rotary locking cylinder with partial views of a key shaft.
Figure 2B:
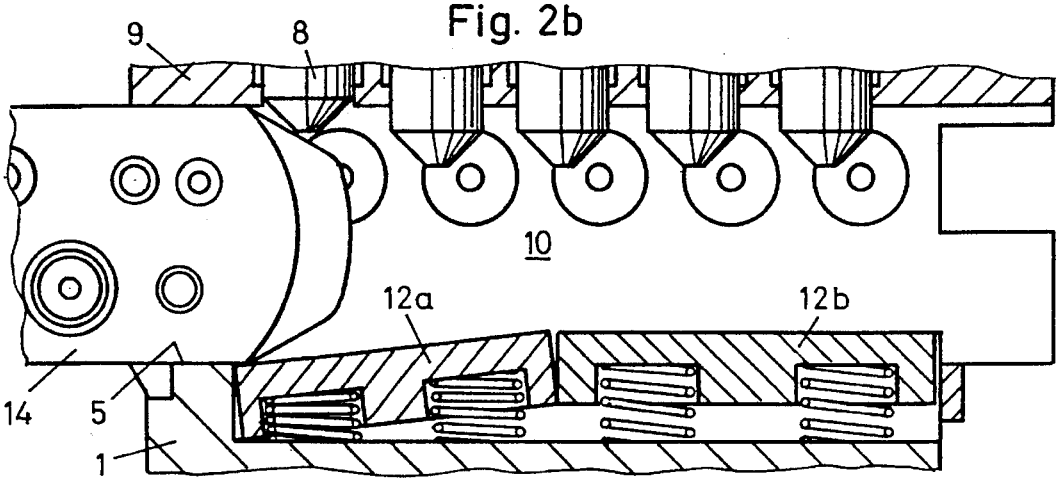
Figure 2C:
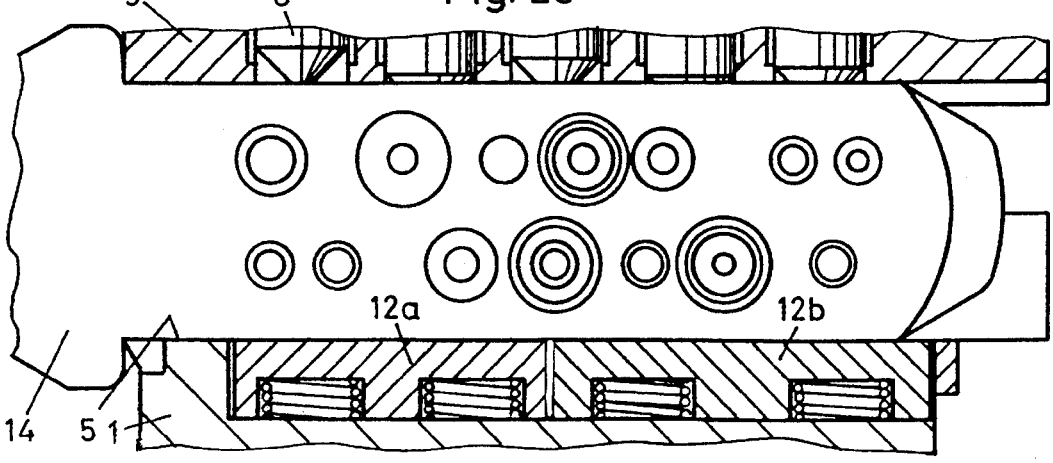
Figure 3:
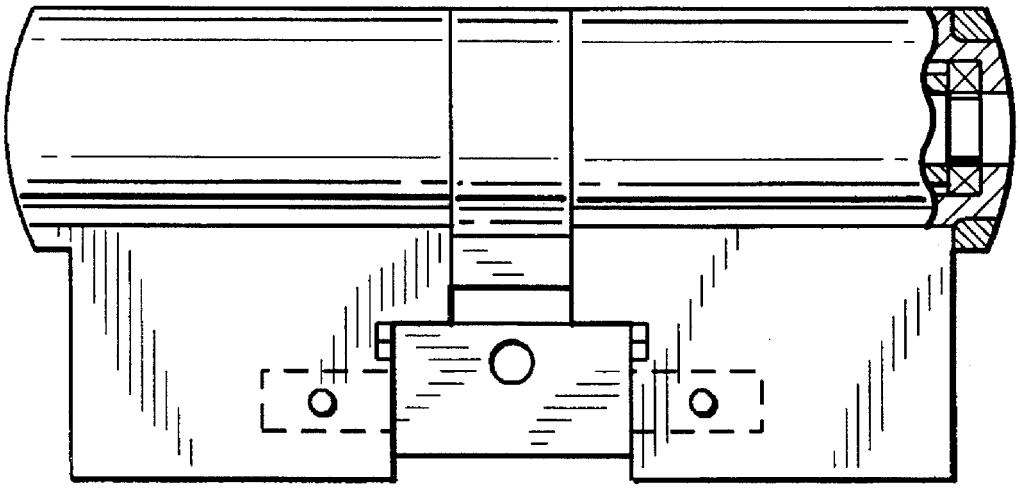
FIG. 3 PRIOR ART
FIG. 3 shows a conventional double cylinder lock connected by a connecting web.

The rotary locking cylinder can be operated in a conventional manner by inserting the correct turning key 14 into the key groove 10 as is shown in FIGS. 2*b* and 2*c*. When the key 14 is inserted into the key groove 10 from the front, as is shown in FIG. 2, part 12*a* first and then part 12*b* are moved downward into the recess 11 against the repelling force of the springs 13. In the position shown in FIG. 2*c* in which the key 14 is completely inserted into the key groove 10, parts 12*a* and 12*b* no longer project beyond the recess 11 at the top and also no longer engage in the key groove 10. Since the tumblers are simultaneously brought into line by the key 14, the rotor 9 is released.

Parts 12*a* and 12*b* have a T-shaped cross section, as is shown in FIG. 1, along their entire length. Accordingly, they have an upper projection 12*c* which is only slightly narrower than the key groove 10. A lower region 12*e* is wider than the key groove 10 and only slightly narrower than the recess 11. The wider region 12*e* accordingly forms a stop which prevents parts 12*a* and 12*b* from being pressed completely into the key groove 10 by the springs 13. When the key 14 is removed, parts 12*a* and 12*b* immediately move automatically into the position shown in FIG. 2*a*.

While the foregoing description and drawings represent the preferred embodiments of the present invention, it will be obvious to those skilled in the art that various changes and modifications may be made therein without departing from the true spirit and scope of the present invention.

What is claimed is:

1. In a rotary locking cylinder for a safety lock including a housing, a rotor, pin tumblers, and biasing means for the pin tumblers, the housing having an end, a length and a bore for receiving the rotor, the rotor providing an opening for receiving a key, the pin tumblers being supported in bore holes in the housing and being moveable within radially positioned openings in the rotor and a cylinder housing, the spring-loaded tumblers being displaceable by a key inserted into a key-groove, the improvement comprising:

a blocking insert which is supported in the housing and which is biased toward the opening for receiving the key, the opening for receiving the key being constructed as a longitudinal slot, said blocking insert being slideable between a blocked and a non-blocked state, said blocking insert occupying said blocked state when a portion of said blocking insert engages the longitudinal slot in said rotor and said blocking insert occupying said non-blocked state when said blocking insert occupies a position wholly within a corresponding longitudinal slot in said housing, the longitudinal slot in said housing extending a distance substantially equal to the length of said housing and being open to the end of said housing; and said blocking insert being adapted to occupy said non-blocked state when the key is inserted in the opening to permit rotation of said rotor.

2. A rotary locking cylinder comprising:

a rotor having a circumferential surface, an external surface, and an internal wall, said circumferential surface, said external wall, and said internal wall being interconnected and defining a longitudinal slot adapted to receive a key, said rotor providing multiple bores through said circumferential surface and said internal wall, each of the bores communicating with the longitudinal slot;

a housing having an end, a length and an internal wall defining an opening adapted to receive said rotor, said internal wall providing a longitudinal slot and multiple bores, the longitudinal slot and each of the bores communicating with the opening, the longitudinal slot and multiple bores of the housing being positioned so as to align with the longitudinal slot and a corresponding one of the multiple bores in said rotor, respectively, when said rotor is rotated to an aligned position relative to said housing, said longitudinal slot extending a distance substantially equal to the length of said housing and said longitudinal slot being open to the end of said housing;

multiple tumblers, each of said tumblers comprising a core pin and a housing pin and being moveable between a locked position and an unlocked position, each of said core pins being slideable in a corresponding one of the bores in said rotor and each of said housing pins being slideable in a corresponding one of the bores in said housing, each of said housing pins being biased toward said opening in said housing and when said rotor occupies said aligned position, said housing pins being biased into contact with said corresponding core pin;

and, a blocking insert being slideable within the longitudinal slot in said housing between blocked and non-blocked positions, said blocking insert being biased toward the opening;

said tumblers occupying said blocked position when said rotor occupies said aligned position and said housing pins of said tumblers extend into a corresponding bore in said rotor;

said tumblers occupying said unlocked position when each of said housing pins is wholly within the corresponding bore in said housing and each of said core pins is wholly within the corresponding bore in said rotor;

said blocking insert occupying said locked position when said rotor occupies said aligned position and a portion of said blocking insert extends into the longitudinal slot in said rotor; and, said blocking insert occupying said non-blocked position when said blocking insert is wholly within the longitudinal slot in said housing, wherein said rotary locking cylinder is adapted to receive the key to achieve said unlocked and non-blocked positions.

3. The rotary locking cylinder of claim 2 wherein said rotary locking cylinder provides multiple lines of radial tumblers.

4. The rotary locking cylinder of claim 2 wherein said blocking insert comprises a spring which is supported by the inner wall of the housing within the longitudinal slot, said spring acting to bias said blocking insert toward the opening.

5. The rotary locking cylinder according to claim 2, wherein said locking cylinder is connected to a connecting web which is connected to a second rotary locking cylinder to form a double locking rotary cylinder.

6. The rotary locking cylinder according to claim 2 wherein said blocking insert comprises a plurality of spring elements arranged in the longitudinal slot of said housing.

7. The rotary locking cylinder according to claim 2, wherein said blocking insert has at least two parts which are movable outward independently from one another against a spring force.

8. The rotary locking cylinder according to claim 2, wherein said blocking insert comprises a part having a first width and a second width, said first width being adapted to slideably engage the longitudinal slot in said rotor and said second width being adapted to slideably engage the longitudinal slot in said housing.

9. The rotary locking cylinder according to claim 7, wherein each part is pressed against the rotor by means of at least two spring elements which are arranged at a distance from one another.

10. The rotary locking cylinder according to claim 7, wherein said parts have bore holes on the underside, a spiral spring supported at the housing engaging in these bore holes.

11. The rotary locking cylinder according to claim 7, wherein said parts of the blocking insert are made of brass.

12. A rotary locking cylinder comprising:

a rotor having a circumferential surface, an external surface, and an internal wall, said circumferential surface, said external wall, and said internal wall being interconnected and defining a longitudinal slot adapted to receive a key, said rotor providing multiple bores through said circumferential surface and said internal wall, each of the bores communicating with the longitudinal slot;

a housing having an end, a length and an internal wall defining an opening adapted to receive said rotor, said internal wall providing a longitudinal slot and multiple bores, the longitudinal slot and each of the bores communicating with the opening, the longitudinal slot and multiple bores of the housing being positioned so as to align with the longitudinal slot and a corresponding one of the multiple bores in said rotor, respectively, when said rotor is rotated to an aligned position relative to said housing, said longitudinal slot extending a distance substantially equal to the length of said housing and said longitudinal slot being open to the end of said housing;

multiple tumblers, each of said tumblers comprising a core pin and a housing pin and being moveable between a locked position and an unlocked position, each of said core pins being slideable in a corresponding one of the bores in said rotor and each of said housing pins being slideable in a corresponding one of the bores in said housing, each of said housing pins being biased toward said opening in said housing and when said rotor occupies said aligned position, said housing pins being biased into contact with said corresponding core pin;

and, a blocking insert comprising a spring supported by the inner wall of said housing in the longitudinal slot thereof to bias said locking insert toward the opening, said blocking insert being slideable within the longitudinal slot in said housing between blocked and non-blocked positions;

said tumblers occupying said locked position when said rotor occupies said aligned position and said housing pins of said tumblers extend into a corresponding bore in said rotor;

said tumblers occupying said unlocked position when each of said housing pins is wholly within the corresponding bore in said housing and each of said core pins is wholly within the corresponding bore in said rotor;

said blocking insert occupying said blocked position when said rotor occupies said aligned position and a portion of said blocking insert extends into the longitudinal slot in said rotor; and, said blocking insert occupying said non-blocked position when said blocking insert is wholly within the longitudinal slot in said housing, wherein said rotary locking cylinder is adapted to receive the key to achieve said unlocked and non-blocked positions; and wherein said rotary locking cylinder provides multiple lines of radial tumblers.

* * * * *